United States Patent [19]

Baldyga

[11] 4,120,135

[45] Oct. 17, 1978

[54] SUPPORTING THIN-WALLED CONTAINERS

[75] Inventor: Eugene P. Baldyga, Springfield, Mass.

[73] Assignee: Monsanto Company, St. Louis, Mo.

[21] Appl. No.: 746,388

[22] Filed: Dec. 1, 1976

[51] Int. Cl.[2] ..... B65B 7/28

[52] U.S. Cl. ..... 53/473; 53/486; 53/367

[58] Field of Search ..... 53/367, 368, 300, 329, 53/37, 38, 40, 35, 42, 3

[56] References Cited

U.S. PATENT DOCUMENTS

| | | | |
|---|---|---|---|
| 1,260,006 | 3/1918 | McDonnell | 53/368 |
| 1,278,829 | 9/1918 | Beck | 53/368 |
| 2,776,531 | 1/1957 | Filander | 53/367 X |
| 2,822,943 | 2/1958 | Fedorchak | 53/317 X |
| 3,064,714 | 11/1962 | Flood | 156/542 |
| 3,688,464 | 9/1972 | Fox | 53/300 X |
| 3,812,646 | 5/1974 | Baldyga et al. | 53/329 X |
| 3,831,344 | 8/1974 | Over | 53/329 |

FOREIGN PATENT DOCUMENTS

| | | | |
|---|---|---|---|
| 492,452 | 9/1938 | United Kingdom | 53/331.5 |

*Primary Examiner*—Horace M. Culver
*Attorney, Agent, or Firm*—Michael J. Murphy

[57] ABSTRACT

In supporting the curved lower portion of a thin-walled plastic container against deflection due to top loading during a filling, capping or like operation in order to prevent damage thereto, the improvement which involves confining support to a localized curved area of such lower portion only while maintaining a seating ring section substantially unsupported, thereby effectively accommodating containers for damage-resistant loading which have incrementally increased in height or assumed slightly off-vertical seating positions due to prior creep.

11 Claims, 5 Drawing Figures

SUPPORTING THIN-WALLED CONTAINERS

BACKGROUND OF THE INVENTION

This invention is directed toward supporting thin-walled containers such as bottles during a filling, capping or like operation, and more particularly toward improvements therein directed toward accommodating the effects of creep in such containers.

U.S. Pat. Nos. 3,812,646 and 3,831,344 disclose a method and apparatus for supporting lower body portions of thin-walled plastic containers against outward deflection and damage during application of a top load in conjunction with a filling, capping or like operation. It is well established as ecologically desirable to reuse such containers many times before eventually discarding them, yet it is also true that when such containers are used in pressure applications at wall thicknesses which are functional and competitive with glass and metal, creep in the thermoplastic material will occur which results in slight deformation of the walls because of exposure to such pressure of the contents. A certain amount of such creep is permanent in that such deformation remains after pressure release, and such permanent creep is necessarily reflected in the condition of the container on the occasion of each of the multiple refillings and recappings. Such creep in the base area where pressure is greatest is not always uniform. For example, a locally thin region tends to creep more than a thicker one with the result that the container leans slightly to one side when self-supporting on a flat surface. Also, an axial increase or growth in overall height can occur when the container has a pressure-resistant raised base extending partially up into the body which partially everts under the influence of pressure, or in other words is urged outwardly of the body interior. Combinations of such height increase in one region of the container periphery plus lean-producing bulge in another region can also occur to complicate attempts to accommodate one or the other of these phenomena.

Though these slight deformities produced by creep can generally be maintained at levels which do not affect performance characteristics or render the containers functionally unacceptable to a customer of the package, they nevertheless can cause serious problems during filling and capping. More specifically, when a rather substantial top load on the order of 20 to 180 or more kilograms is applied to such a container in connection with application of a pressure resistant closure to its open end, it is conventional, as disclosed in the above mentioned patents, to envelop the lower end of the container with a support cap to prevent collapse of such area due to the applied load. However, certain horizontal and vertical tolerance limits must be maintained between the container and the cooperating location of the filling and capping apparatus components in order for the latter to function successfully. Thus, if the container is too tall, it cannot be accommodated in the vertical space between the filling or closure-applying head of the apparatus and the support member for the base, whereas if the container is canted in its supported position due to the effect of uneven creep, such heads will not seat or cooperate evenly with the wall surface around the opening of the upper end of the container with the result that the latter will be crushed or otherwise damaged during the filling or closure-applying operation because of application of the top load to a surface which is too limited in area.

SUMMARY OF THE INVENTION

Now, however, process improvements have been developed for use in supporting relatively thin-walled containers during filling and capping which accommodate containers which have partially grown in size due to creep of the thermoplastic material thereof.

Accordingly, it is a principal object of this invention to provide process improvements for supporting containers made of thermoplastic material during application of a top load thereto.

Another object is to provide process improvements in supporting plastic bottles which have been previously exposed to internal carbonated beverage pressures and are intended to be refilled for additional use.

A further object is to simplify bottom-support capping equipment.

Other objects will in part be obvious and will in part appear from the following description and claims.

These and other objects are accomplished in the process of protecting the fragile lower portion of a thin-walled plastic container during axial loading while filling, capping or the like which includes the step of supporting such lower portion against deflection, while the load is applied by providing the improvement which comprises confining such support to a localized curved area of said lower portion while maintaining a seating ring section substantially unsupported during loading.

BRIEF DESCRIPTION OF THE DRAWINGS

In describing the invention, reference will be made to the accompanying drawings wherein.

DETAILED DESCRIPTION OF ILLUSTRATED EMBODIMENTS

Figure 1:
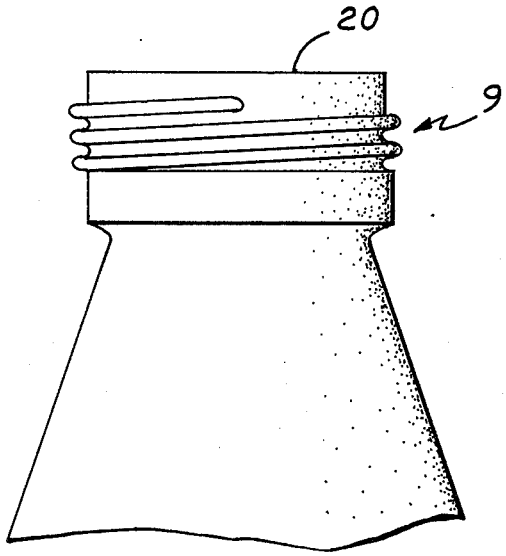
FIGS. 1–3 are partial, vertical, sectional views of containers supported in accordance with the invention.
Figure 1:
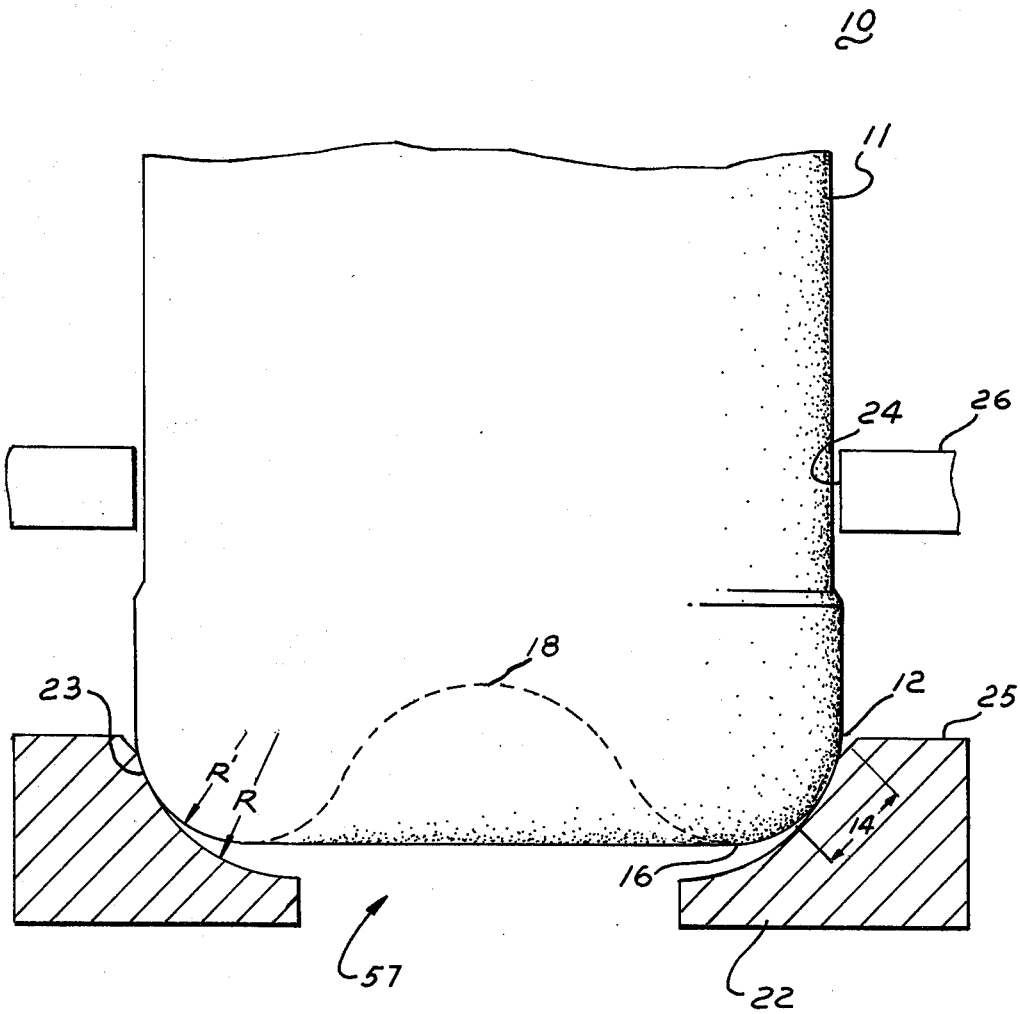

Referring now to the drawings, a container preferably in the form of a one-piece bottle 10 is illustrated in FIG. 1 which, though functional in non-pressurized applications, is particularly intended for holding contents under rather substantial pressures on the order of about 2 to 9 kg. per sq. cm. Though it may be of any shape, for example having angularly related walls forming corners, bottle 10 is typically circular in peripheral contour and is formed of relatively thin-walled thermoplastic material such as a high barrier resin, for example a copolymer wherein the major constituent is polymerized nitrile monomer. Bottle 10 has axially spaced finish and curved lower portions joined by sidewall 11. Vertically straight lower end 12 of sidewall 11 merges into such lower portion at an initial rounded chime area which in turn smoothly meets a circumferentially extending seating ring portion 16 on which bottle 10 rests when standing erect in a stable, self-supporting manner on a flat surface. Though such seating ring is shown as providing line contact with a flat surface, it may alternatively have some horizontal width. Raised, inwardly concave inner base portion 18 extends into the body and closes the lower portion of bottle 10. The details of such lower portion, considered herein to be below a substantially vertically straight lower end of a sidewall, may vary from the configuration just described, but it is preferred for good pressure and impact resistance that a rounded area be present preferably between a seating ring portion and the lower end of a sidewall portion which is relatively thin-walled on the order of about 15 to 60 mils and preferably previously molecularly oriented in the forming operation.

With reference to a closure, not shown, for sealing dispensing opening 20 at the upper end of sidewall 11 and the associated operation of a capping head for applying such closure to finish 9, reference may be made to U.S. Pat. No. 3,812,646, col. 5, line 59 through col. 6 line 37, the content of which is incorporated herein by reference.

Prior to exposure to internal pressures of the magnitude indicated previously herein, the contour of bottle 10 is as shown in solid lines in FIG. 1. As broadly disclosed in U.S. Pat. No. 3,812,646, support for protection of the fragile lower portion of bottle 10 is necessary during axial loading while filling or capping or performing a like operation. This is accomplished in the present invention by enveloping a localized curved area 14 with annular encircling member 22 having rigid, load bearing surface 23 configured to allow area 14 of the bottle to assume its own tangential contact points therewith when the bottle is disposed coaxially with member 22 and preferably with a contactless disposition of seating ring 16. In the embodiment of FIG. 1 radius R of surface 23 is greater than R′ of localized area 14 in order to accomplish this. With this arrangement, localized area 14 is physically restrained against outward deflection and damage through immediate fracture, assumption of a permanently distorting set or stress cracking leading to later fracture during use. Seating ring 16 is protected from such load since it is well above the subjacent portion of surface 23, it being realized that the latter alternatively could even be cut back further in the horizontal direction so as to be non-existent beneath 16. Such support is effectively accomplished in FIG. 1 through limited concentric contact between the downside surface of the relatively narrow annulus conforming to area 14 and the opposite facing portion of surface 23 just below (on the order of about 1.2 to 2.5 cm.) upper face 25 of vertically shallow member 22. As a feature of the invention, this limited support facilitates later lateral movement of bottle 10 out of the force-applying station after completion of the work therein performed on bottle 10, since such movement without tipping can be accomplished simply through contact with the closely surrounding surfaces 24 of horizontally movable pockets of star wheel guide 26. In other words, though usable, spring biased reciprocable plunger elements as disclosed in U.S. Pat. No. 3,831,344 which have been previously utilized axially subjacent the bottle in the force-applying station to urge bottle 10 upwardly out of supported position in a rather deep cup after release of the top load are not required. The complexity of the apparatus for bottom support capping accordingly may be rather substantially reduced.

Figure 2:
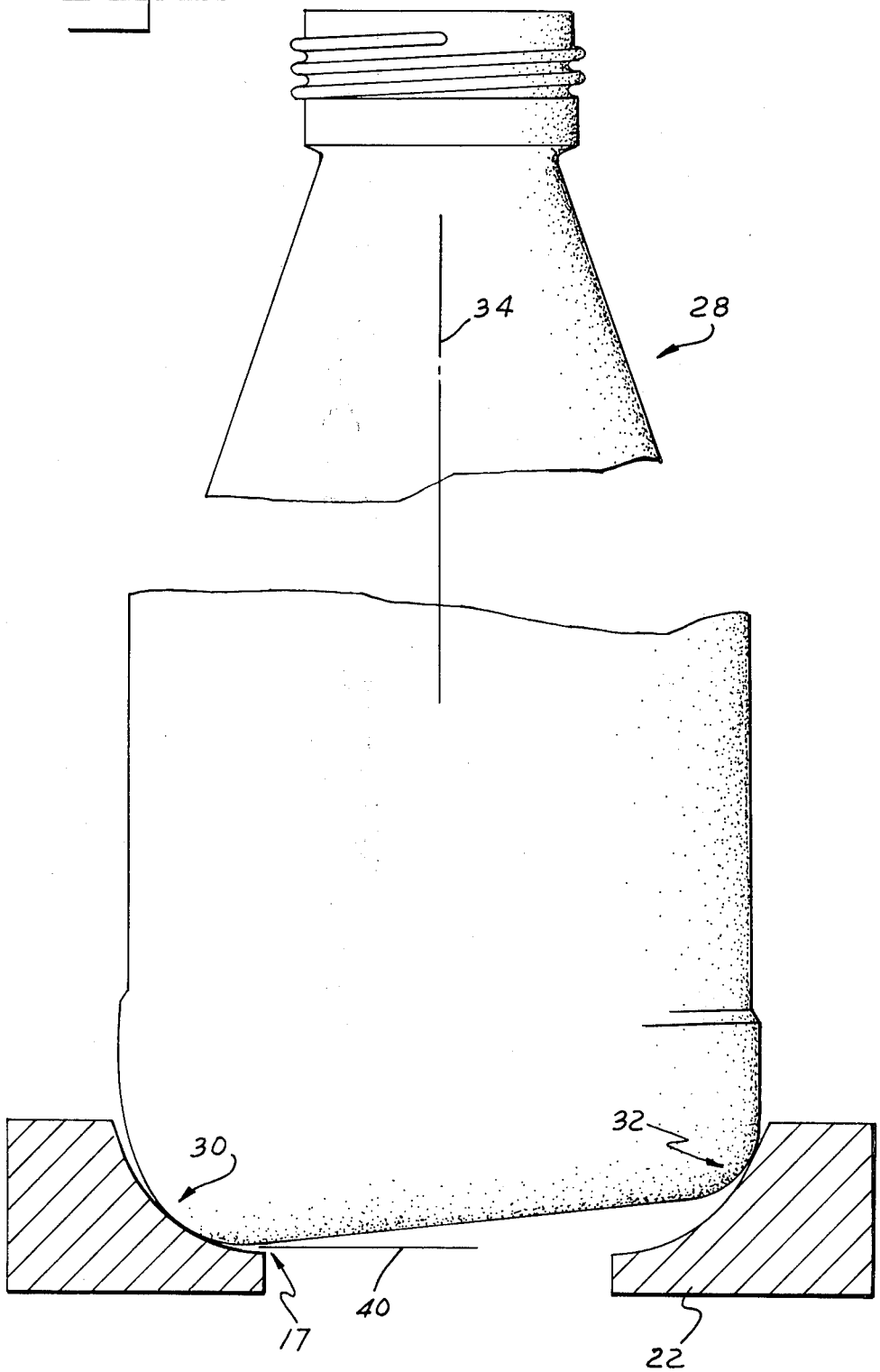
Figure 5:
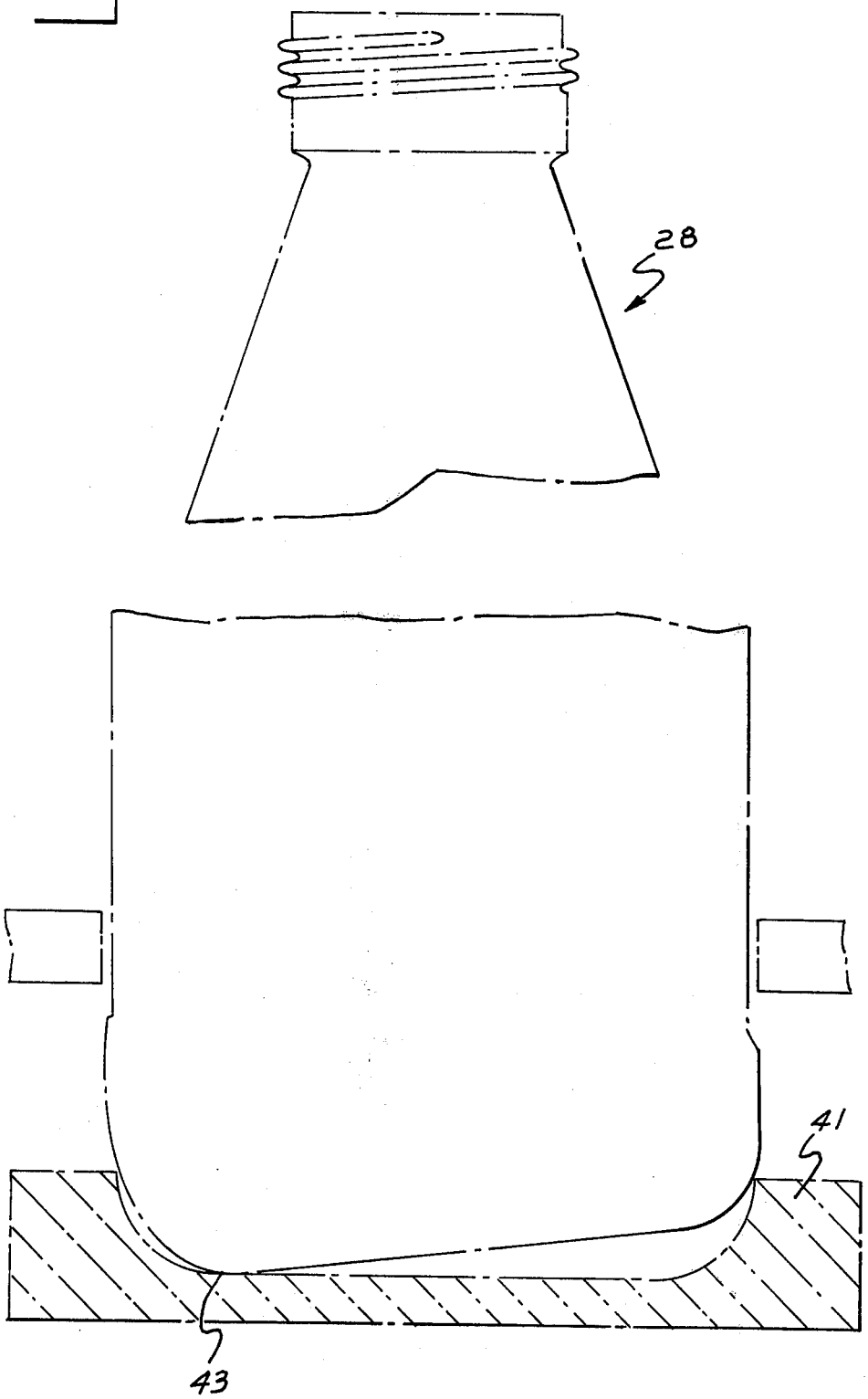

Referring now to FIG. 2, bottle 28, which had a surface contour prior to initial use identical to bottle 10 of FIG. 1, is illustrated in somewhat exaggerated form in the lower body portion to reflect some dimensional instability developed during exposure to internal pressure, as for example during containment of a carbonated beverage at room temperature. As apparent, uneven creep has occurred in the girth direction in the walls of the curved lower portion of bottle 28 in that a peripheral segment identified as 30 has bulged or enlarged more than another adjacent segment 32 forming a different portion of the periphery. If container 28 in the form illustrated in FIG. 2 is placed on a planar support surface, it will lean so that axis 34 will be out of perpendicular on the order of about 0.38 to 1.1 cm. from the vertical and therefore at an acute angle to the plane of such surface. Under such conditions, application of a vertical load to the upper end of such a canted bottle can damage, e.g. crush the wall in the fragile lower body portion. In accordance with the invention, when star wheel pockets or equivalent means which can be manual or manually applied around the body of the bottle above the supported lower portion, not shown, urge bottle 28 into member 22, tangential support of the type depicted in FIG. 2 results in that greater-crept segment 30 is seated along a portion of the support surface lower down then where lesser or substantially non-crept segment 32 is seated at a different higher vertical elevation. Such asymmetrical support in a localized curved area of the lower portion of bottle 28 occurs pretty much automatically when the bottle-containing indexing pocket of the star wheel guide moves into position coaxially above the cuplike support member. As depicted, this asymmetrically supported position of bottle 28 causes axis 34 to lie substantially perpendicular to horizontal plane 40 and therefore the flat, top, load-receiving face of the finish around the opening at the upper end of the bottle sidewall to lie parallel to plane 40. In other words, with such positioning, though seating ring 17 is canted, the finish portion around the opening nevertheless lies in a substantially horizontal plane ready for smooth cooperation with the load-applying member, not shown. Also, contact with seating ring 17 is desirably substantially avoided as shown. Such positioning in the doughnut-shaped support of FIGS. 1 and 2 avoids the crushing which would otherwise occur if bottle 28 were snugly inserted in closed-bottom, prior art support member 41 of FIG. 5 configured to substantially exactly match the contour of the lower portion of the bottle and loaded from above, in that the bottle axis and finish would be out of perpendicular even though the lower portion was well supported. On the other hand, if such axis and finish are straightened by star wheel pockets in the prior art support member, as depicted in FIG. 5, some parts of the localized area of the curved lower portion will be highly stressed at a point or along a line during loading which is undesirable and results in damage to the container of the type sought to be avoided. Also, unwanted supportive contact of seating ring 43 most likely will occur as shown.

Figure 3:
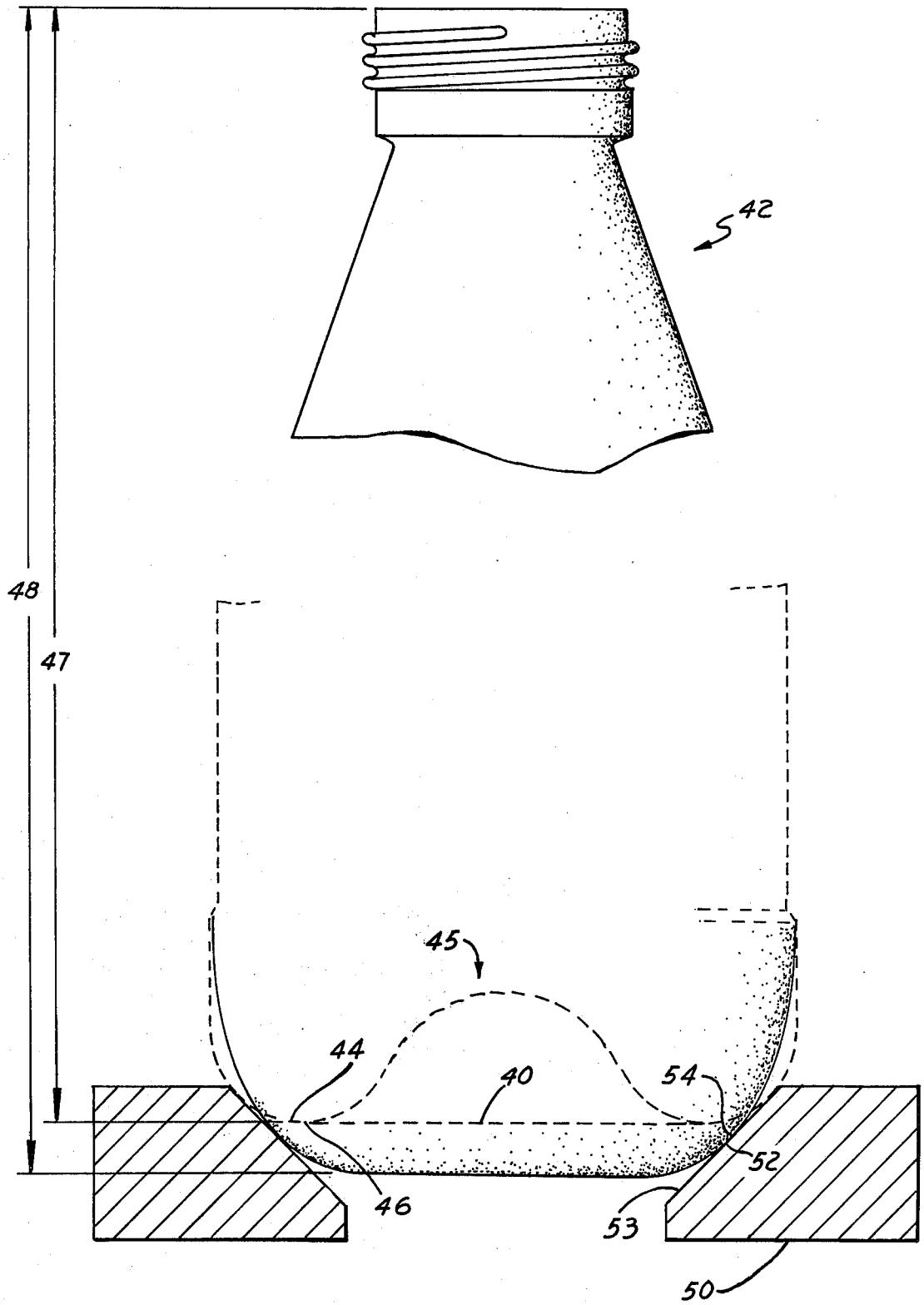
Figure 4:
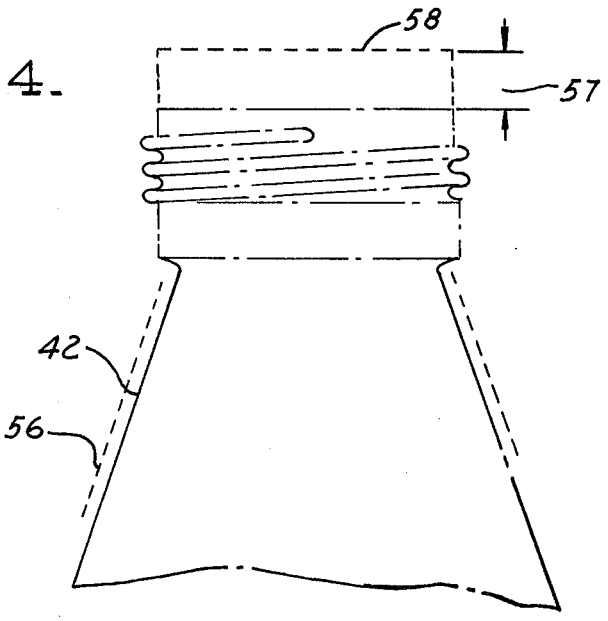
FIGS. 4 and 5 are views similar to FIGS. 1–3 of containers supported in accordance with the prior art.
Figure 4:
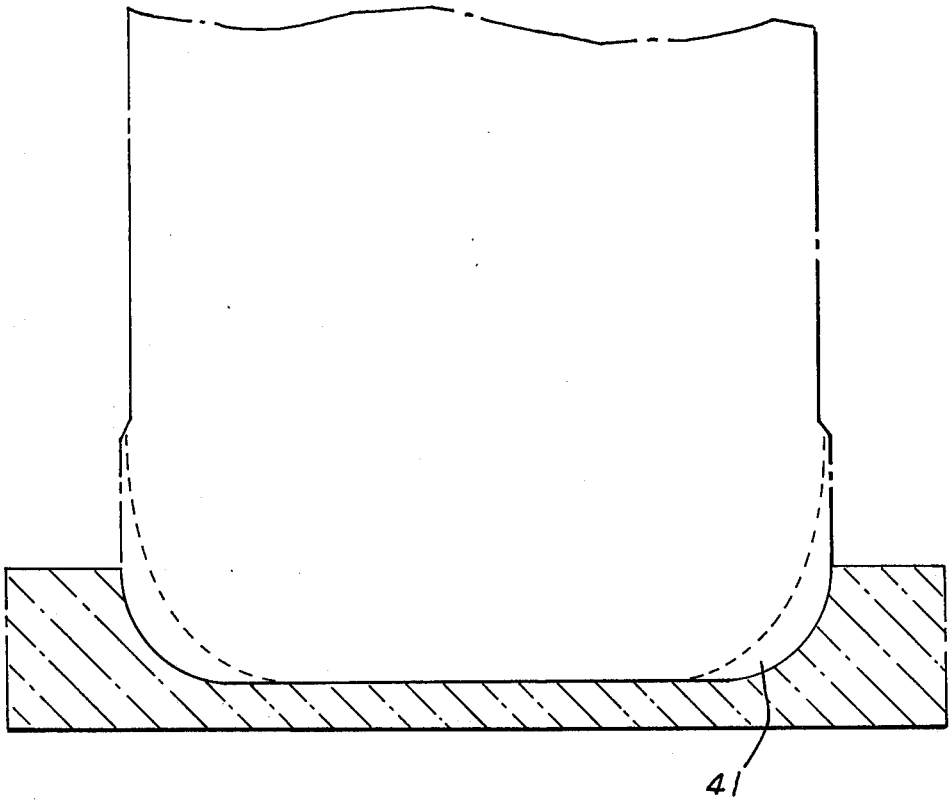

Referring now to FIG. 3, bottle 42 shown in solid lines was initially identical to that of FIGS. 1 and 2 with dotted line 44 depicting the initial outer peripheral contour of the lower portion prior to pressure exposure. Because of such exposure raised inner base portion 45 has partially everted which caused downward and outward displacement of the wall in the region of seating ring portion 46 such that the latter (depending on the extent of wall movement) generally moved into the position previously occupied by the localized curved area where support was applied during initial loading of the empty bottle, such area itself now being offset and disposed somewhat further up with respect to the lowermost point on the bottle than before pressurization. Though the enlarged contour of the lower portion of the bottle will vary one to the next depending on many factors and generally will seldom be exactly the same for each, such contour is typically indicated by the solid line position of the walls in FIG. 3. This form of local creep as just described typically results in an overall height increase of about 0.32 to 0.64 cm. in container 42 — from that shown at 47 in FIG. 3 to that shown at 48. This unpredictable and variable growth is nevertheless frequently beyond the vertical tolerance allowed between the operating location of the bottle-contacting portions of the filling or capping head and the immediately adjacent load-receiving bottle surfaces. Thus, it has been conventional to set the load-applying member with respect to the upper face 58 of the bottle at a nominal position when using closed-bottom cuplike prior art member 41 of FIG. 4, but if bottle growth is not as great as it could be, the load during capping is less than desired which can affect the integrity of the resulting seal, whereas if the reverse is true and growth is on the high side, loading can be excessive and bottle damage such as stress cracking in the lower supported portion can result. In FIG. 4, 57 represents the difference in height between a container 42 before and after pressure exposure with the contour after pressure labeled 56 therein. In accordance with the embodiment of FIG. 3, however, abutting surface to surface engagement of newly displaced localized area 52 will automatically occur along portion 54 of inwardly inlined tapered planar surface 53 of member 50 which, because of the reduction in the diameter in the support area, is lower down along surface 53 than where such contact existed prior to bottle growth. In this way container height increase is compensated for and automatically effectively accommodated with the improved support of the invention and the crushing occuring when support is according to that shown by the prior art in FIG. 4 is accordingly avoided. As also apparent from FIG. 3, the seating ring of the grown bottle will desirably be unsupported during axial loading to avoid any stressing thereof. The tapered support surface of FIG. 3 is equally effectively usable with the peripherally uneven creep described with respect to FIGS. 1 and 2 and is preferred since it is easier to fabricate and facilitates smooth ramp-like sideways movement of the bottles out of the filling, capping or like station after completion of the work thereon.

Though the invention for purposes of clarity has been described wherein uneven creep as illustrated in FIG. 2 occurs separately from the version shown in FIG. 3, it should be understood that combinations of same will occur which can be accommodated by the improved support of the invention. Though support around the fill periphery during load application is preferred, it may be discontinuous in the sense of relatively short gaps existing on the order of up to about 66% around the periphery of the localized area of the rounded bottom portion wherein contact with the support member does not exist due to the configuration of either the supported area of the bottle itself or that of the support member.

Though the advantages of the invention have been described and are particularly effective with reusable plastic containers, such are equally applicable to single trip, non-reusable versions where direct loading of the seating ring area is preferably avoided.

EXAMPLE

A thin-walled plastic bottle weighing on the order of 85 grams and formed of a copolymer of 70/30 weight percent polymerized acrylonitrile/styrene is filled to a nominal capacity of 32 fluid ounces with a cola beverage containing 4.0 volumes of carbon dioxide. The initial contour prior to previous exposure to 8.75 kg. per sq. cm. internal pressure is as shown for bottle 10 in FIG. 1 with localized area 14 having a thickness on the order of 20–25 mils and a single radius R′ of 1.12 cm. Because of such prior pressure exposure a portion of the lower body generally in the curved area at the lower end of the sidewall had unevenly enlarged in one portion of the periphery versus another so that when such container is seated on a flat surface it leans to the extent of being displaced some 0.955 cm. from the vertical. Such bottle is positioned in a capping station below an Alcoa® model 212 series capping head and seated in a circular cuplike support member of the type illustrated in FIG. 3 wherein the tapered support surface is at an angle of 35° with the horizontal and the open cylindrical area below is approximately 2½ inches in diameter. When such container is in position in the cuplike support such that its vertical axis is perpendicular thereto, the most enlarged portion is found to be supported further down on one side of the tapered surface than that which had enlarged less, thereby avoiding any offset at all in the bottle finish in its supported position, with the result that the sealing surface of the finish is perpendicular to the capping head. In such seated position, the seating ring of the bottle is completely out of contact with the support member. The tolerance setting between the bottom surface of the capping head and the upper sealing surface of the bottle finish is preset to ± 0.159 cm. prior to sealing. Such capping head is caused to move downwardly so as to seat under pressure on the top surface of the finish of the bottle after a closure has been loosely disposed thereon in the manner generally described in U.S. Pat. No. 3,812,646. This results in a top load on the order of 180 kg. being applied on such surface of the locally supported bottle during the rolling of an aluminum closure wall into surrounding contact with threads formed around the bottle finish and the support provided in the localized area of the rounded lower portion is found to protectively prevent any type of damage whatsoever to such lower portion. This undamaged condition prevailed throughout subsequent storage and conventional handling in connection with reuse of the refilled bottle.

A second container capped as just described is placed in an oven at 100° F. to test for the effect of any stress cracking which might have occurred during capping and is found by visual inspection after one week to show no evidence whatsoever of damage in the lower portion of the bottle body including the seating ring area.

For purposes of comparison, another bottle identical to those described above prior to pressure exposure is inserted into a closed-bottom support of the type shown in U.S. Pat. No. 3,812,646 and when such bottle is snugly fully seated therein it is found that the sealing surface of the finish is not perpendicular to the capping head and is displaced therefrom by some 0.380 cm. total. Under such conditions it is determined to be impossible to effectively seal the cap to the finish at all, so such bottle is repositioned to bring the sealing surface and capping head into perpendicularity with the result that the chime and seating ring are positioned in the support member generally as shown in FIG. 5. Use of the same 180 kg. load on the sealing surface under these conditions results in a greater loading of one particular segment of the lower portion of the bottle than another which causes fracture to occur along a limited arcuate portion of the seating ring (43 in FIG. 5) on which the top load was concentrated, thus rendering the filled container completely unusable.

The above description and particularly the drawings are set forth for purposes of illustration only and are not to be taken in a limited sense. Various modifications and alterations will be readily suggested to persons skilled in the art. It is intended, therefore, that the foregoing be considered as exemplary only and that the scope of the invention be ascertained from the following claims.

What is claimed is:

1. In the process of protecting the fragile lower portion of a thin-walled plastic bottle having axially spaced upper finish and lower curved portions during axial loading of the bottle while filling, capping or the like which includes the step of restraining said lower portion against substantially radially outward deflection while said load is applied without supporting the finish portion, the improvement which comprises:

confining said restraint against substantially radially outward deflection to a localized curved area of said lower portion while maintaining a seating ring section unsupported during said loading.

2. The process of claim 1 wherein said support is accomplished through tangential contact with an enveloping rigid surface.

3. The process of claim 1 wherein prior to loading such container has grown in height due to exposure to internal pressure.

4. In a process of protecting a thin-walled plastic container during loading wherein such container includes a finish portion axially spaced from a fragile, curved, lower portion having slightly asymmetrical walls from prior uneven creep which cause the container to lean when seated on a flat surface, the steps comprising:

(a) providing a shallow encircling member having a surface for tangentially restraining a localized area of said lower portion against substantially radially outward deflection;

(b) bringing said surface and localized area into supportive contact with each other such that a portion of such localized area which had crept to one extent is seated along a portion of the surface at a different vertical elevation from that for a portion which had crept to a different extent;

whereby the finish portion of the supported container is in a substantially horizontal plane; and then (c) applying a top load to such container in conjunction with a filling, capping or the like operation without preferentially loading one portion of the localized area substantially more than another.

5. The process of claim 1 wherein said lower portion comprises a seating ring section adapted to self-support the container when said container stands erect on a flat surface, such seating ring portion being bounded on one side by an inner base portion extending into the body of the container and on the other side by said localized curved area.

6. The process of claim 5 wherein said seating ring portion has a finite horizontal width in a direction radial to the container axis.

7. The process of claim 4 wherein the contour of the support surface of the encircling member is similar to but does not match that of the localized area of the lower portion.

8. The process of claim 4 wherein said load is applied in conjunction with a capping operation.

9. The process of claim 7 wherein during step (b) a seating ring section between said localized area and the container axis is unsupported.

10. The process of claim 7 wherein said container is a bottle.

11. The process of claim 7 wherein the vertical axis of such container is at an acute angle to a horizontal surface when such container is seated on such horizontal surface.

* * * * *